US006010213A

United States Patent [19]

Kanaya et al.

[11] Patent Number: 6,010,213

[45] **Date of Patent: *Jan. 4, 2000**

[54] INK SUPPLY DEVICE FOR USE IN INK JET PRINTER AND INK TANK FOR USE IN THE SAME DEVICE

[75] Inventors: Munehide Kanaya, Suwa; Hisashi Miyazawa, Suwq, both of Japan

[73] Assignee: Seiko Epson Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/560,053

[22] Filed: Nov. 7, 1995

[30] Foreign Application Priority Data

| | | | |
|---|---|---|---|
| Nov. 18, 1994 | [JP] | Japan | 6-284824 |
| Nov. 18, 1994 | [JP] | Japan | 6-284825 |
| Jan. 17, 1995 | [JP] | Japan | 7-022295 |
| Jul. 17, 1995 | [JP] | Japan | 7-202855 |
| Nov. 7, 1995 | [JP] | Japan | 7-313614 |

[51] Int. Cl.[7] ..... B41J 2/175

[52] U.S. Cl. ..... 347/87; 141/351; 251/149.1

[58] Field of Search ..... 347/84, 85, 86, 347/87; 400/124.1; 141/351, 364, 366; 222/501; 251/149.1

[56] References Cited

U.S. PATENT DOCUMENTS

| | | | |
|---|---|---|---|
| 4,509,062 | 4/1985 | Low et al. . | |
| 4,771,295 | 9/1988 | Baker et al. . | |
| 4,794,409 | 12/1988 | Cowger et al. . | |
| 5,025,271 | 6/1991 | Baker et al. . | |
| 5,116,021 | 5/1992 | Faust et al. | 251/149.1 |
| 5,182,581 | 1/1993 | Kashimura et al. | 347/87 |
| 5,280,300 | 1/1994 | Fong et al. . | |
| 5,426,459 | 6/1995 | Kaplinsky . | |
| 5,509,140 | 4/1996 | Koitabashi et al. | 347/86 |

FOREIGN PATENT DOCUMENTS

| | | | |
|---|---|---|---|
| 381-392 | 8/1990 | European Pat. Off. | 347/86 |
| 0 444 861 | 9/1991 | European Pat. Off. . | |
| 0 518 380 | 12/1992 | European Pat. Off. . | |
| 0-581-531-A1 | 7/1993 | European Pat. Off. . | |
| 0 580 433 | 1/1994 | European Pat. Off. . | |
| 0 581 531 | 2/1994 | European Pat. Off. . | |
| 43 28 001 | 2/1995 | Germany . | |
| 5-96744 | 4/1993 | Japan | 347/86 |
| 6-106730 | 4/1994 | Japan | 347/85 |

OTHER PUBLICATIONS

Webster's II New Riverside University Dictionary, p. 1227, 1994.

*Primary Examiner*—N. Le
*Assistant Examiner*—Judy Nguyen
*Attorney, Agent, or Firm*—Stroock & Stroock & Lavan LLP

[57] ABSTRACT

An ink supply device includes an ink container connected to an air communication port through a porous member. The ink container is maintained at a negative pressure equivalent to the capillary force of the ink penetrated into the porous member. Since the ink container is in communication with the air through a wide area of the porous member, the ink container can be maintained at a constant negative pressure regardless of the quantity of ink consumed by the recording head.

13 Claims, 15 Drawing Sheets

INK SUPPLY DEVICE FOR USE IN INK JET PRINTER AND INK TANK FOR USE IN THE SAME DEVICE

BACKGROUND OF THE INVENTION

The invention relates generally to an ink supply device and an ink tank mounted on a carriage carrying an ink jet type recording head thereon, and more particularly, to a ink supply device which maintains ink in a container at a constant negative pressure irrespective of the ink consumed by a recording head to thereby supply ink to the recording head with accuracy.

In a conventional ink jet printer comprises a carriage having an ink jet type recording head mounted thereon. The recording head applies pressure to a pressure generation chamber in communication with a common ink chamber and a nozzle opening to thereby cause ink drops to be jetted out from the nozzle opening. The recording head further includes an ink cartridge for supplying ink to the ink jet type recording head. In this manner, as the carriage moves in reciprocating directions, the ink drops are jetted out onto recording paper in response to the data to be printed.

In a previous ink jet printer, the nozzle opening of the recording head is situated at a position lower than the ink liquid surface of the ink cartridge. Therefore, a head pressure is applied to the nozzle opening. To deal with this pressure, a porous elastic member, formed of foam, rubber or the like, is stored within the ink cartridge and the pressure of the ink cartridge is set slightly lower than the nozzle opening due to the surface tension of the porous elastic member to prevent the ink from oozing from the nozzle opening.

This structure does not solve all the pressure problems. For example, if the consumption of the ink advances so that the quantity of the ink absorbed in the porous elastic member is reduced to a small quantity, then the surface tension of the porous elastic member is increased. Therefore, the supply of ink to the recording head is not stable so that the ink stored within the cartridge cannot be completely consumed. Also, because the quantity of the ink to be stored within the cartridge is reduced by a quantity corresponding to the substantial volume of the porous elastic member, the size of the ink cartridge must be increased to compensate for the increase in volume. Further, there is a possibility that air bubbles contained in the porous elastic member may flow into the recording head.

U.S. Pat. No. 4,794,409 was developed to overcome some of the above-mentioned problems. This patent discloses an ink supply system in which a porous member is compressed and inserted between an ink container, not in communication with the air, and a recording head in such a manner as to form capillary spaces in part of the porous member. Further, adjacent to the porous member, a cavity is formed to serve as an ink reservoir. Based on this construction, the ink of the ink container is discharged into the ink reservoir and the ink is supplied from the ink reservoir through the porous member to the recording head to apply a negative pressure to the recording head due to the capillary force of the porous member. However, since the ink container, ink reservoir and capillary spaces are all formed as closed areas, the ink cannot be supplied stably from the ink container to the recording head.

To solve the above problem, it is possible to provide a structure as shown in FIGS. 25(*a*), (*b*) and (*c*). Referring to FIG. 25(*a*), a fine tube C is connected to a bottom portion B of an ink container A. A space D of ink container A is open to an air port E of fine tube C. Ink is supplied from an ink supply port F of bottom portion B to an ink jet type recording head. Based on this structure, the air is allowed to enter from a bottom portion G of fine tube C to thereby generate air bubbles K before space D can be made to communicate with air port E. As shown in FIG. 25(*b*), the ink jet type recording head functions as a suction pump P when the pressure of space D of ink container A decreases to a level to overcome the capillary force of fine tube C.

Due to the above operation, it is possible to maintain space D of ink container A at a negative pressure so as to maintain the printing operation of the ink jet type recording head. However, in graphic printing or the like, where the recording head uses a large quantity of ink, the inflow of the air through fine tube C does not catch up with the quantity of the ink consumed by the recording head. Therefore, the negative pressure in space D of ink container A is increased so that the supply of the ink to the ink jet type recording head stops frequently, thereby interrupting the printing operation of the ink jet type recording head as shown in FIG. 25(*c*). In addition, if the liquid surface of the ink decreases to bottom portion G of fine tube C, then there is no capillary force in fine tube C. Thus, the negative pressure of space D cannot be maintained. As a result thereof, a large quantity of ink may be supplied, thereby causing the ink to leak out and air bubbles to invade into the ink jet type recording head.

Accordingly, it is an object of the invention to provide an ink supply device which can maintain ink in an ink container at a constant negative pressure regardless of the quantity of the ink consumed by a recording head to thereby supply the ink to the recording head with accuracy.

SUMMARY OF THE INVENTION

Generally speaking, in accordance with the invention, an ink supply device for use in an ink jet printer having an ink jet type recording head for outputting ink is provided. The ink supply device includes a holder having a first side and a second side. The ink jet type recording head is mounted on the first side of the holder. The holder includes at least one space for receiving at least one porous member having an affinity for ink. The ink container includes an enclosed space for storing ink. The ink container is removably mounted on the second side of the holder. The ink container further includes at least one opening for communicating with the holder. An ink supply passage is positioned between the holder and ink jet type recording head. An air port is positioned on the holder for receiving air. The air port is in contact with the at least one porous member. Based on this arrangement, ink stored in the ink container flows from the opening of the ink container through the ink supply passage into the ink jet type recording head. The ink container is in communication with the air received by the air port communicating with the at least one porous member.

Accordingly, it is an object of the invention to provide an improved ink supply device.

A further object of the invention is to provide an ink supply device which can maintain ink in an ink container at a constant negative pressure regardless of the quantity of the ink consumed by the recording head to thereby supply the ink to the recording head with accuracy.

Still another object of the invention is to reduce the cost for manufacturing an ink supply device.

Still other objects and advantages of the invention will in part be obvious and will in part be apparent from the specification.

The invention accordingly comprises the features of construction, combinations of elements, and arrangements of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 2(*b*) is a plan view of the porous member employed in FIG. 2(*a*);

FIG. 19(*b*) is a side sectional view of the ink container of FIG. 18 showing the ink consumption stage;

FIG. 20(*b*) is a side sectional view of the ink container of FIG. 18 showing a state thereof when the ink is poured into the ink container;

FIG. 24(*b*) is a perspective view of the spring of FIG. 24(*a*); and

DESCRIPTION OF THE PREFERRED EMBODIMENTS

Figure 1:
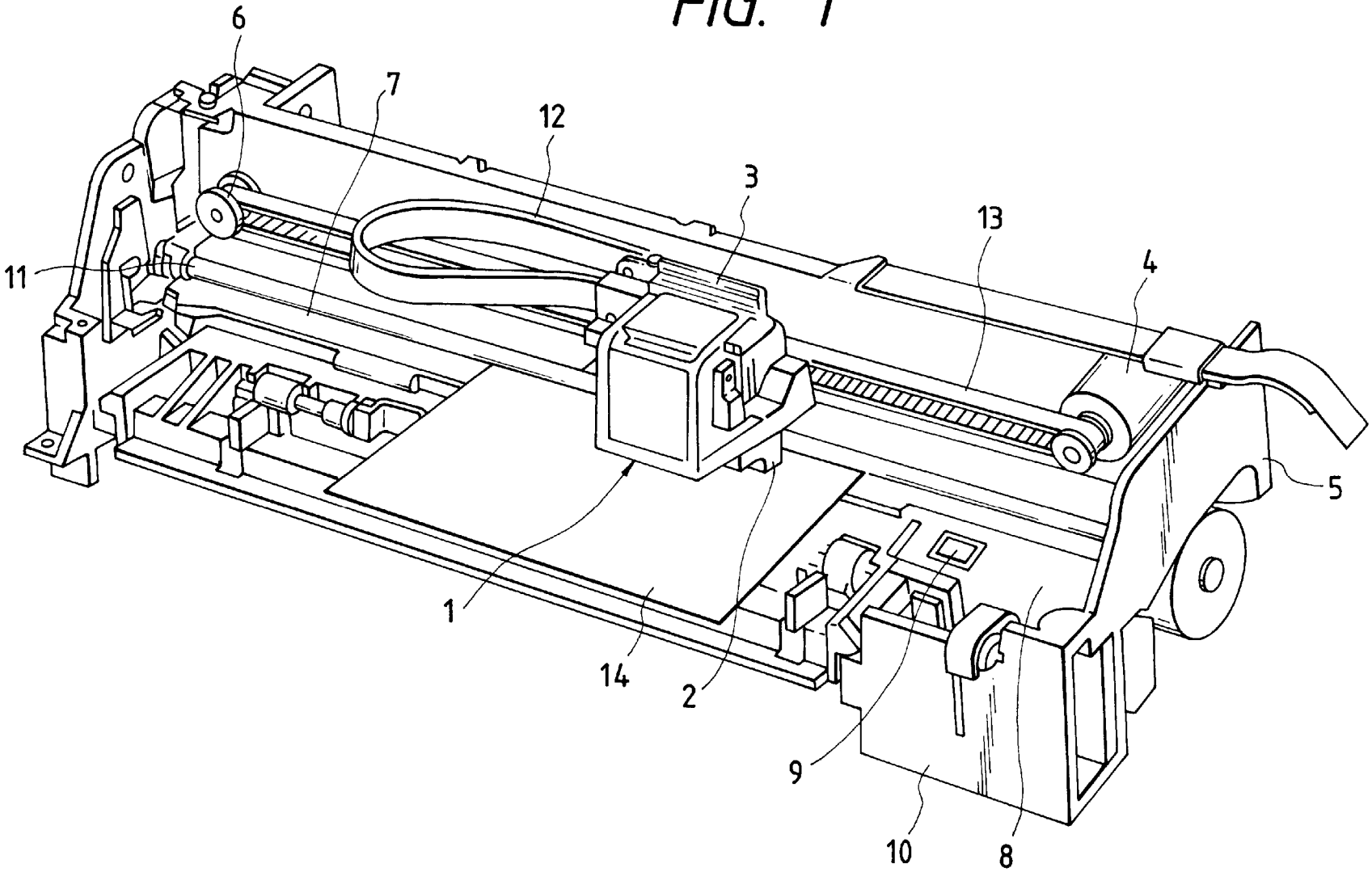
FIG. 1 is a perspective view of an embodiment of an ink jet type recording apparatus in accordance with the invention.

Reference is first made to FIG. 1, which an embodiment of an ink jet type recording apparatus for mounting an ink cartridge on an ink supply device in accordance with the invention. An ink jet type recording head 2 is mounted on a carriage 1. Recording head 2 is positioned on the lower surface of carriage 1, while an ink container 3, which forms an ink supply device, is removably mounted on the upper surface of carriage 1. A pulse motor 4 is provided to move carriage 1 in parallel to a platen 7 through a timing belt 13 extended between pulse motor 4 and an idler 6, provided on one end of a base member 5. Carriage 1 also moves on a guide member 11. A flexible cable 12 supplies a drive signal to recording head 2 to output ink onto recording paper 14.

A capping assembly 8 is disposed outside a printing area. When the ink supply device is out of operation, capping assembly 8 seals the nozzle surface of recording head 2 with a cap member 9 thereof. When an ink cartridge is replaced, a negative pressure is applied by a suction pump 10 to the nozzle opening of ink jet type recording head 2 through capping assembly 8 to thereby forcibly discharge the ink.

Figure 2A:
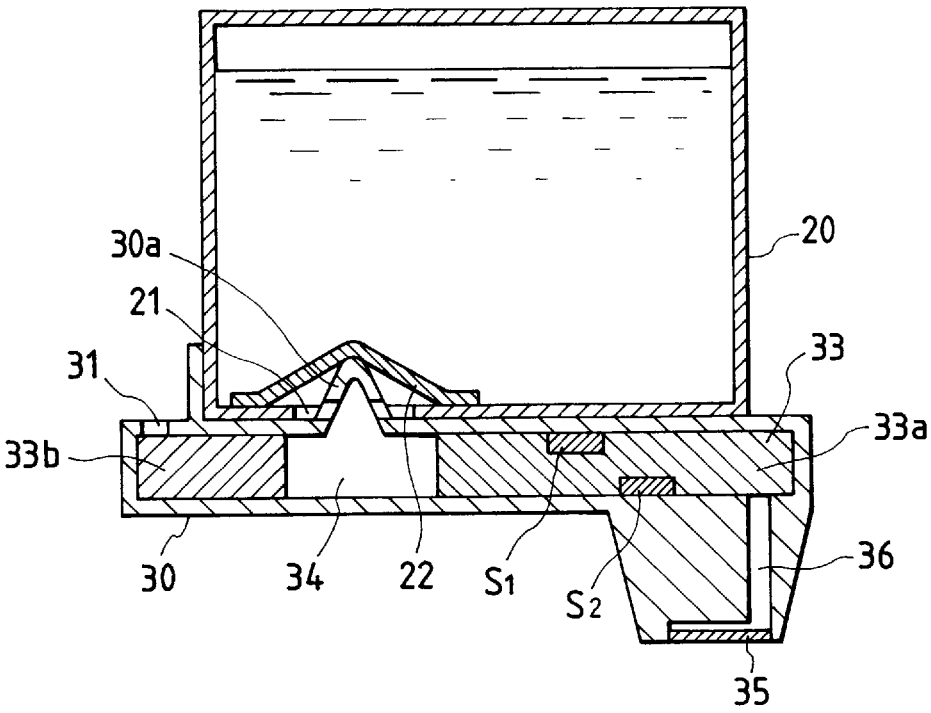
FIG. 2(*a*) is a side view of a first embodiment of an ink supply device in accordance with the invention.
Figure 2B:
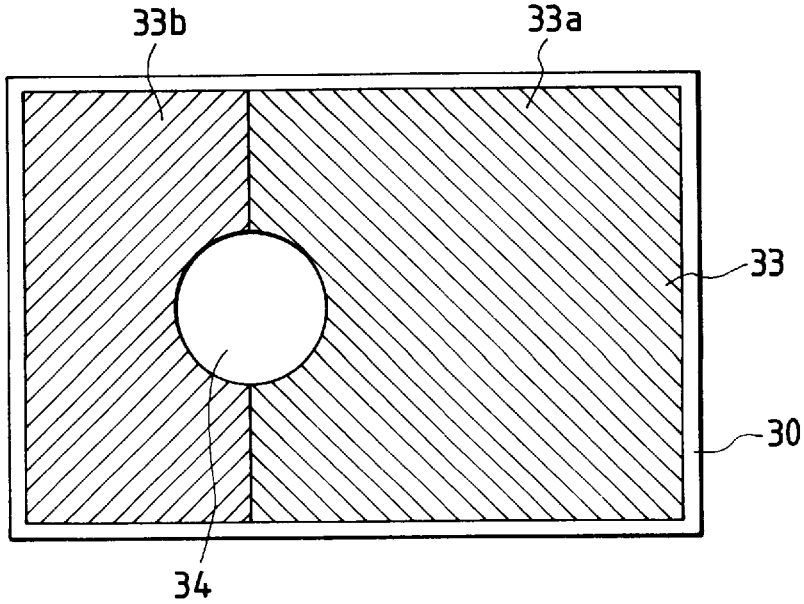
Figure 3:
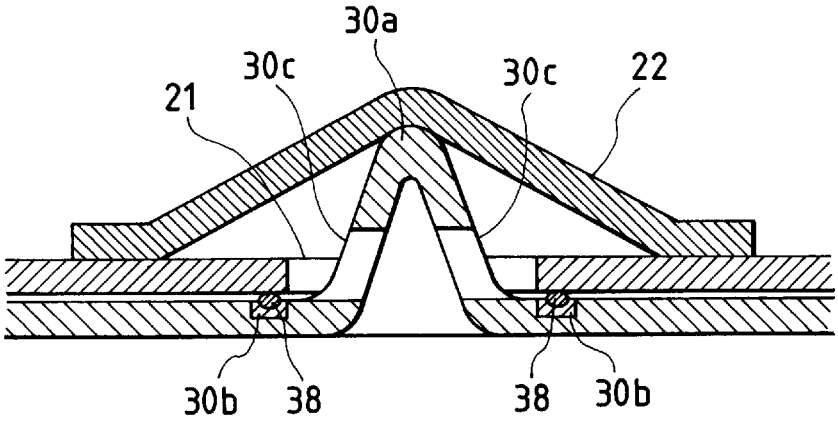
FIG. 3 is a partial enlarged sectional view of the structure of the opening formed in the ink supply device of FIG. 2(*a*)

Referring to FIGS. 2*a*, 2*b* and 3, an ink supply device is divided into an ink container 20 and a holder 30 for removably mounting ink container 20 thereon. A recording head 35 extends from holder 30. Ink container 20 is a closed container with an opening 21 formed on the bottom portion thereof as more specifically shown in FIG. 3. Opening 21 is sealed by a valve 22, formed by an elastic film or diaphragm, which may be opened when pushed upwardly as will also be described below in greater detail. Annular ribs 38 are provided on the lower end of ink container 20 surrounding opening 21 to cooperate with annular packings 30*b* on the upper surface of holder 30 to maintain the sealed condition of opening 21.

Ink container 20 may be mounted on the upper surface of holder 30. Holder 30 is also a closed container for storing porous member 33 as will be described below in greater detail. A projecting portion 30*a* on holder 30 is used to open valve 22 of container 20 by pushing it in an upward direction. Projecting portion 30*a* includes holes 30*c* to allow ink to flow from valve 22 into an ink reservoir 34. Holder 30 includes air communication port 31 positioned away from opening 21.

Porous member 33 is divided into two areas 33*a* and 33*b* as shown in FIG. 2(*b*). Below opening 21 of ink container 20, a space is formed to provide an ink reservoir 34. Porous member 33 is constructed such that area 33*b*, essentially positioned between ink reservoir 34 and air communication port 31, has a higher affinity for the ink than area 33*a*, positioned between ink reservoir 34 and ink supply passage 36. Porous member 33 may be formed from ceramics or hollow thread bundles having a pore diameter of 20 $\mu$m, which (1) allow the ink to pass therethrough, (2) allow air bubbles contained in the ink to be caught in pores thereof, and (3) prevent the natural outflow of the ink by means of the capillary force thereof Electrodes S1 and S2, used to detect the end of the ink as an electric resistance, are positioned in the open container portion of holder 30. In the case of the embodiment of FIG. 2(*a*), the electrodes are located in a spaced relation with portions of region 33*a* of porous member 33 therebetween.

When ink container 20 is mounted on holder 30, valve 22 is opened by projecting portion 30*a*. Based thereon, ink in ink container 20 is allowed to flow into ink reservoir 34 through openings 21 and 30*c*. The ink is first absorbed into area 33*b* of porous member 33 and then into area 33*a*. Because area 33*b* is filled first with ink, air communication port 31 is cut off from ink reservoir 34. In this manner, ink in ink reservoir 34 of holder 30 is allowed to flow from the ink supply passage 36 into recording head 35 through area 33*a* of porous member 33 without air being let in from air communication port 31.

When ink container 20 is mounted on carriage 1, the ink supply passage is connected to an ink supply port (not shown) of recording head 2. When recording head 2 is moved to a capping position, cap member 9 contacts the nozzle surface of recording head 2 to thereby apply negative pressure of suction pump 10 to the nozzle surface of recording head 2.

Since the flow rate of the ink in this suction process is very fast as compared to the time when the ink is consumed in printing, air bubbles and the remaining air in ink reservoir 34 are carried by the flow of the ink and are discharged externally through recording head 2. When a weak negative pressure is applied to ink supply passage 36 and ink reservoir 34 is in communication with air communication port 31 through porous member 33, the ink stored in ink reservoir 34 is caused to flow through porous member 33 at a minute flow rate into ink supply passage 36. In this process, the air bubbles contained in the ink are caught into the pores formed in porous member 33 and are thereby prevented from flowing into recording head 35.

The air bubbles are strongly attached to the pores of porous member 33, and thereby operate as plugs to block the ink flow path. Accordingly, the ink is forced to flow around the pores with the air bubbles caught therein. In this manner, the air bubbles contained in the ink are caught one after another in the pores and thus only the ink with the air bubbles removed therefrom is allowed to flow into recording head 35.

If the consumption of the ink is stopped due to interruption of the printing operation of the recording head, then the air bubbles caught in the pores are separated from the fine holes or pores of porous member 33. Due to the expansion of the pores caused by variations in temperatures, the air bubbles are then moved into ink reservoir 34. Thereafter, the air bubbles are discharged into ink container 20. Alternatively, because the operation of the negative pressure produced by the consumption of the ink by recording head 35 is eliminated, the air bubbles dissolve in the ink and disappear. Throughout the operation of the printer, the air bubbles contained in the ink will be caught in the pores of porous member 33. When the ink consumption is stopped, then the air bubbles will be discharged into ink container 20. This operation will continue so long as the ink is being consumed.

Figure 25A:
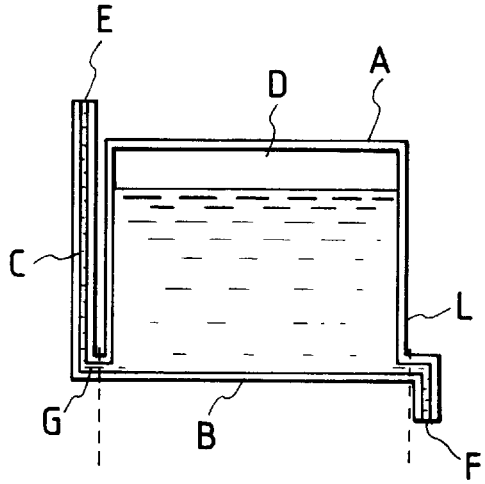
FIG. 25(a) PRIOR ART
FIGS. 25(*a*), (*b*) and (*c*) are views of an ink supply operation to be performed in accordance with the prior art.
Figure 25B:
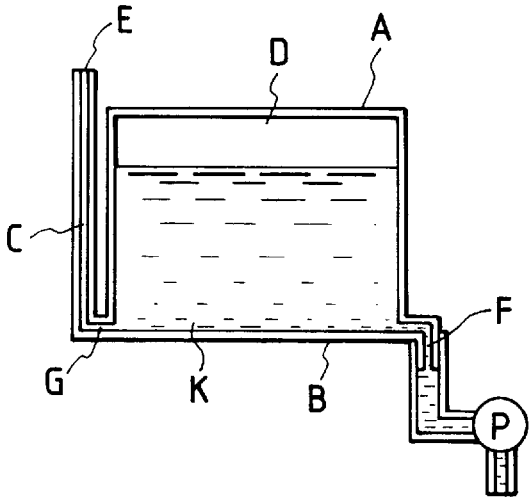
FIG. 25(b) PRIOR ART
Figure 25C:
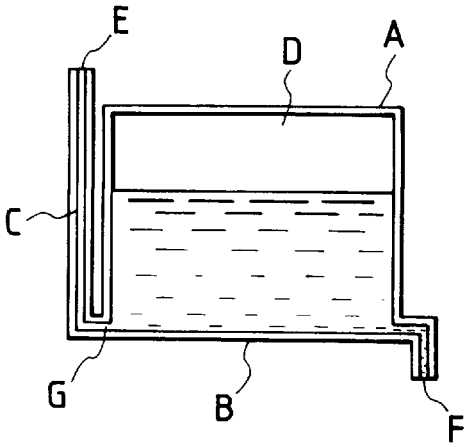
FIG. 25(c) PRIOR ART

Based on this construction, ink container 20 is in communication with the air due to the air that is absorbed in ink area 33*b* of porous member 33. Thus, container 20 is able to receive air even when a large quantity of ink is consumed by recording head 35. Therefore, the possibility that the ink can run short, as in a structure in which an ink container is in communication with the air through fine tube C as shown in FIG. 25, is eliminated and the ink may be properly supplied based on the quantity of the ink consumed by recording head 35.

Figure 4:
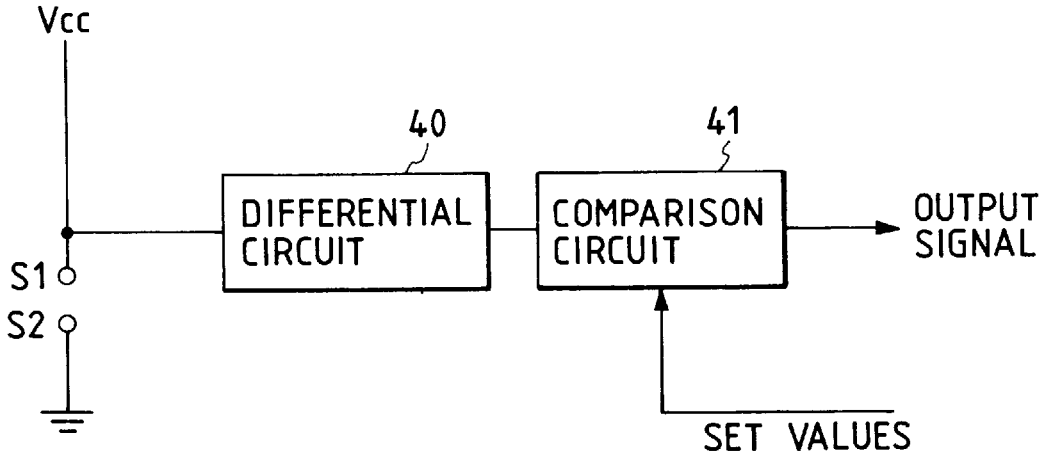
FIG. 4 is a block diagram of the ink end detector of FIG. 2(*a*)

As the ink contained in ink container 20 is being consumed and the ink in porous member 33 is being reduced, then the resistance values of the electrodes S1 and S2 are rapidly increased. The monitoring of the ink supply in porous member 33 is conducted by the circuit of FIG. 4. More specifically, electrodes S1 and S2 are connected to a differential circuit 40, which is connected to a comparison circuit 41. When comparison circuit 41 determines that the resistance value between electrodes S1 and S2 has reached a set value indicating that the quantity of ink remaining is approaching zero, a signal indicating the end of the ink is outputted. In fact, even if the ink stored in ink container 20 is entirely consumed, the capillary force of porous member 33 prevents the inflow of the air, thereby preventing the air bubbles from flowing into recording head 35, because reservoir 34 and ink container 20 are in communication with port 31 through the ink that is absorbed in area 33*b* of porous member 33.

Figure 5:
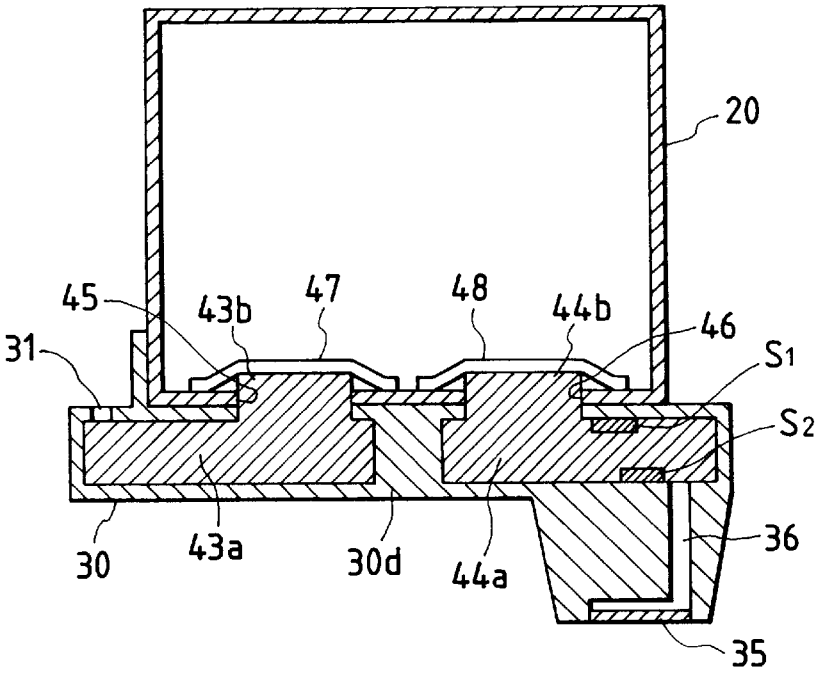
FIG. 5 is a side sectional view of another embodiment of an ink supply device in accordance with the invention.
Figure 6:
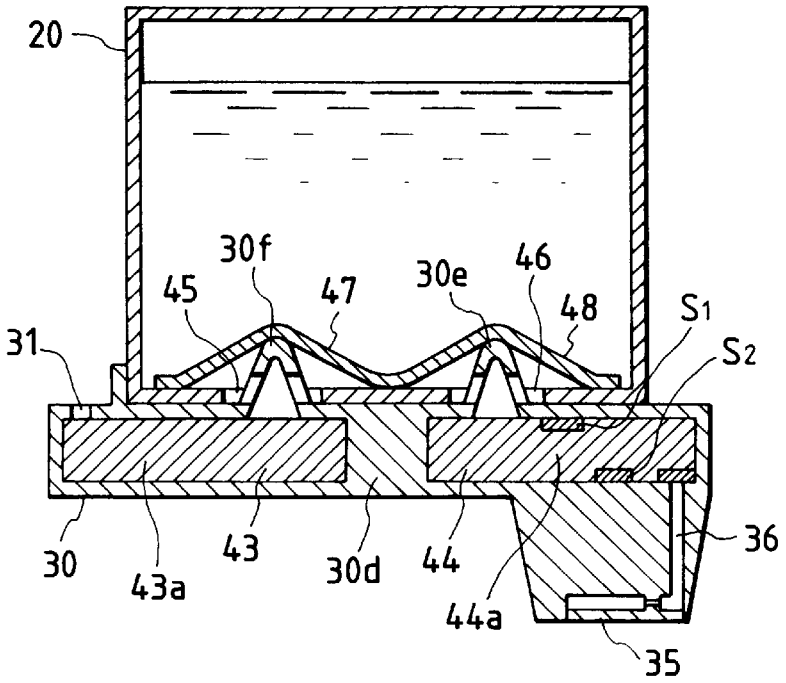
FIG. 6 is a side sectional view of yet another embodiment of an ink supply device in accordance with the invention.

Reference is now made to FIGS. 5 and 6, which disclose a second and third embodiment, respectively, of an ink supply device according to the invention. Like numbers are used to denote like parts. In these embodiments, the space of holder 30 is divided into two chambers 43 and 44 by a partition wall 30*d*. Porous members 43*a* and 44*a* are loaded into chambers 43 and 44 respectively. Formed on upper ends of porous members 43*a* and 44*a* in the embodiment of FIG. 5 are upwardly projecting portions 43*b* and 44*b*. A portion of porous member 43*a* positioned away from projecting portion 43*b*is in communication with an air communication port 31, while the lower surface of porous member 44*a*is in communication with an ink supply passage 36. The bottom portion of ink container 20 includes through holes 45 and 46, covered by diaphragm valves 47 and 48, which projecting portions 43*b*and 44*b* can be inserted into respectively. In use, diaphragm valves 47 and 48 are opened by projecting portions 43*b*and 44*b*respectively. In place of projecting portions 43*b*and 44*b*, which are used to open diaphragm valves 47 and 48, projecting portions 30*f* and 30*e* in holder 30 may be used to have the similar effect as shown in FIG. 6.

When container 20 is mounted on holder 30 in the embodiment of FIGS. 5 and 6, similar to the above-mentioned first embodiment, diaphragm valves 47 and 48 are then pushed up by projecting portions 43*b*and 44*b*, so that the ink stored in ink container 20 can be absorbed into respective porous members 43*a* and 44*a*. When the ink in porous member 44*a*is consumed by recording head 35, ink container 20 supplies the ink to recording head 35 through porous member 44*a*.

Even if a large quantity of ink is consumed by recording head 35, ink container 20 is able to take in the air to avoid the short supply of the ink, because ink container 20 is in communication with the air through the ink absorbed into porous member 43*a* through port 31. In this manner, the ink can be properly supplied in accordance with the quantity of the ink consumed by recording head 35 for printing. In addition, even if the ink in ink container 20 is completely consumed, the capillary force of porous member 43*a* prevents the inflow of the air, because ink container 20 is in communication with the air through the ink that is absorbed into porous member 43*a*. In this manner, air bubbles are prevented from flowing into recording head 35.

When the ink is initially loaded into holder 30 and recording head 35 using suction pump 10 for drawing ink from ink container 20 toward recording head 35 through cap member 9 as shown in FIG. 1, it is possible to prevent the air from flowing from air communication port 31 into ink container 20 by setting the affinity and pore size greater for porous member 43*a* associated with air communication port 31 than that of porous member 44*a*.

Figure 7:
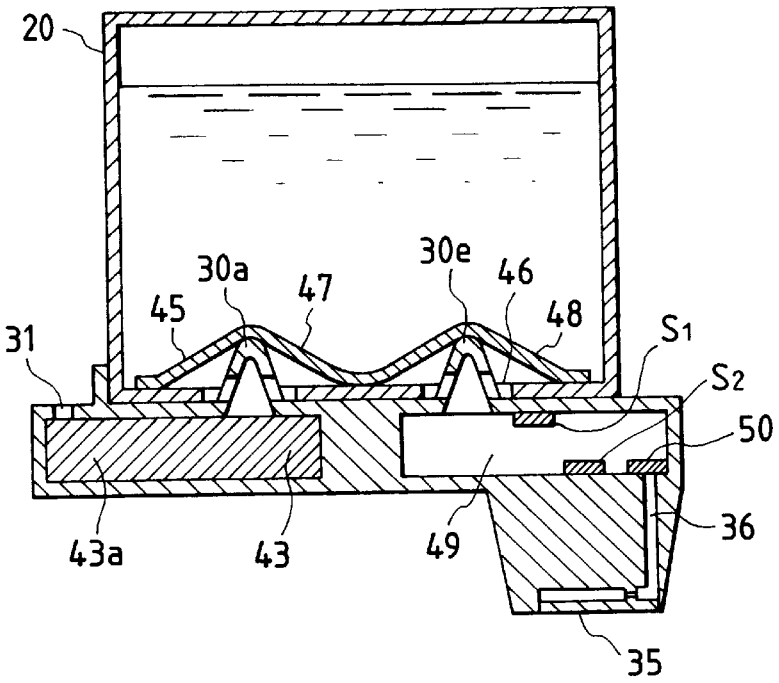
FIG. 7 is a side sectional view of still another embodiment of an ink supply device in accordance with the invention.

FIG. 7 discloses a modification of the embodiment shown in FIGS. 5 and 6. Like numbers are used to denote like parts. In this fourth embodiment, porous member 43*a* is stored in chamber 43 of holder 30 on the air communication port 31 side. However, a porous member is not stored in chamber 44*a*of holder 30 on the ink supply passage 36 side. In this embodiment, when ink container 20 is mounted on holder 30, diaphragm valves 47 and 48 are opened by projecting portions 30*a* and 30*e*. Thereafter, ink stored in ink container 20 is absorbed into porous member 43*a*. Air communication port 31 is cut off from ink container 20 with the ink that is absorbed into porous member 43*a*.

In this construction, if a negative pressure is applied to recording head 35 from outside by suction pump 10, then the ink in ink container 20 flows into a chamber 49 through opening 46. In addition, ink container 20 communicates with air at a time when the pressure of ink container 20 decreases to a level equal to the surface tension of ink in porous member 43*a*. In this manner, a constant negative pressure is maintained within ink container 20. When the ink in chamber 49 is consumed by recording head 35 and the pressure of the ink is thereby decreased to the surface tension of porous member 43*a*, the air flows into ink container 20 through air communication port 31. As a result, the pressure of container 20 returns to the optimum pressure for printing. In the construction of FIG. 6, a filter member 50 may be positioned on the opening of ink supply passage 36 to further move the air bubbles.

Figure 8:
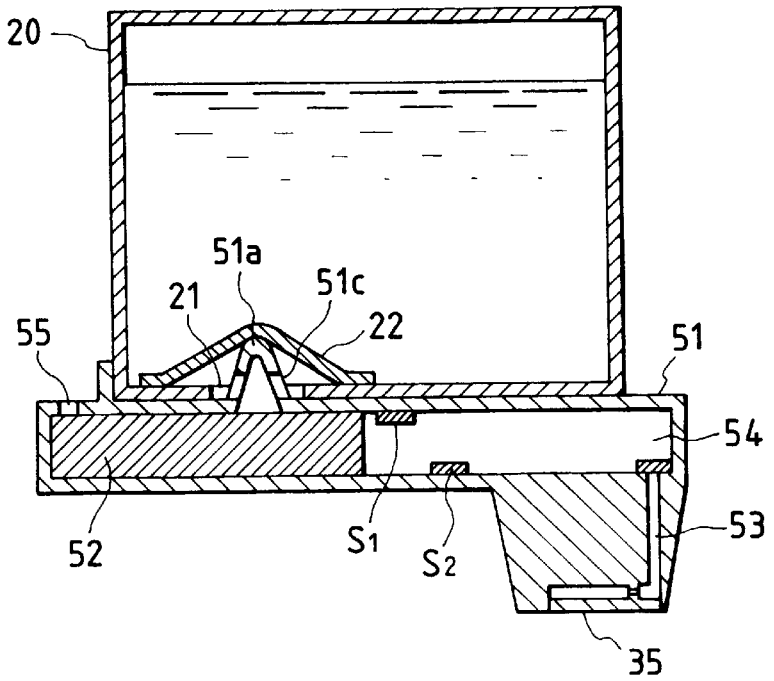
FIG. 8 is a side sectional view of another embodiment of an ink supply device in accordance with the invention.

Reference is now made to FIG. 8, which discloses a fifth embodiment of an ink supply device according to the invention. Like numbers are used to denote like parts. Ink container 20 is mounted on an upper surface of a holder 51. Holder 51 is constructed as a container for storing a porous member 52, which will be described below. A projecting portion 51*a* of holder 51 is positioned opposed to opening 21 of ink container 20. Projecting portion 51*a* is used to open diaphragm valve 22 of ink container 20. Projecting portion 51*a* includes a through hole 51*c* that allows the ink from diaphragm valve 22 to pass therethrough. An ink supply passage 53 receives ink from ink reservoir 54 connected to at least recording head 35, while porous member 52 is positioned in holder 51 to seal opening 21 and air communication portion 55. When ink container 20 is mounted on holder 51, diaphragm valve 22 is opened by projecting portion 51*a* so that the ink in ink container 20 can be absorbed into porous member 52. As a result, air communication port 55 is cut off from ink container 20 by the ink that is absorbed in porous member 52.

When negative pressure is applied to recording head 35 from outside, then the ink flows through porous member 52 into ink reservoir 54. At the same time, ink container 20 is allowed to communicate with the air when the pressure of container 20 decreases to a level equal to the surface tension of ink in porous member 52. As a result, a constant negative pressure is maintained within ink container 20. When the ink in ink reservoir 54 is consumed by recording head 35, the pressure of ink container 20 decreases to the surface tension of ink in porous member 52. The air then flows from air communication port 55 into ink container 20 to thereby return the substantially decreased pressure of ink container 20 to the optimum pressure for printing.

Figure 9:
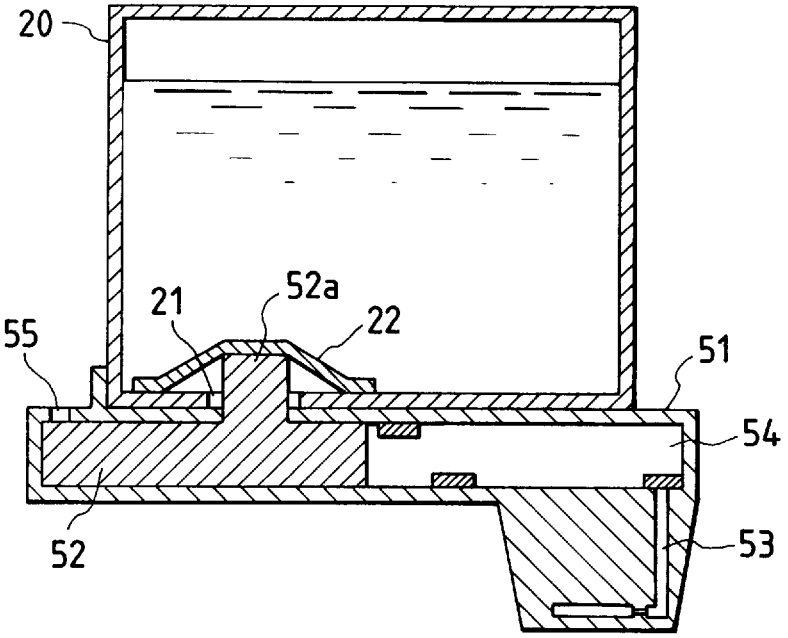
FIG. 9 is a side sectional view of yet another embodiment of an ink supply device in accordance with the invention.

FIG. 9 discloses another embodiment of an ink supply device according to the invention. In this embodiment, rather than using a projecting portion 51*a* of holder 51 as disclosed in embodiment of FIG. 8, a projecting portion 52*a*, similar to the embodiment of FIG. 5, is formed on porous member 52. Projecting portion 52*a* is used to open diaphragm valve 22.

Figure 10:
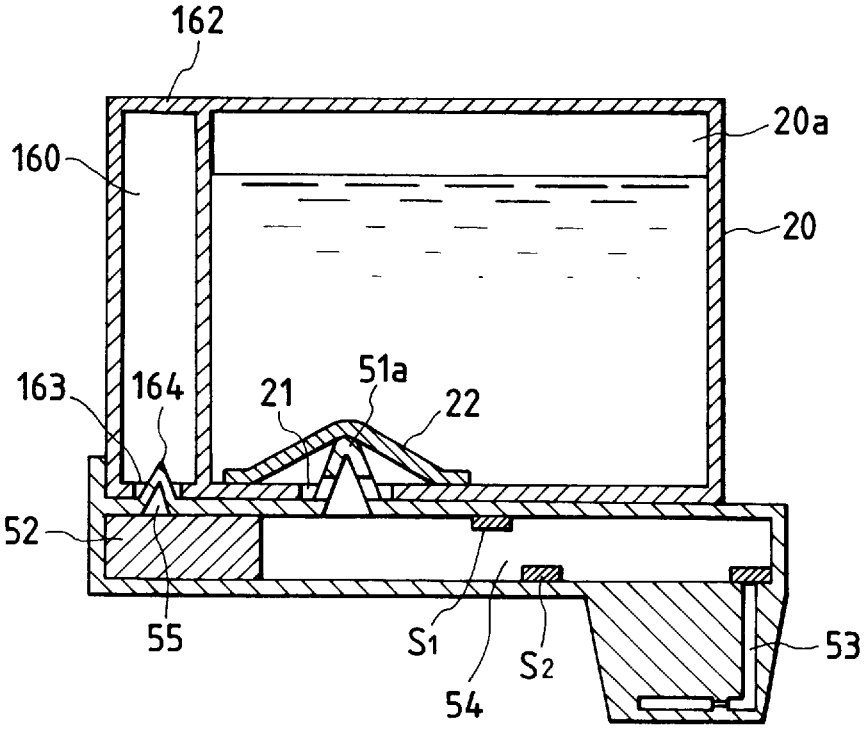
FIG. 10 is a side sectional view of another embodiment of an ink supply device in accordance with the invention.

Reference is now made to FIG. 10, which discloses still another embodiment of an ink supply device. Like numerals are used to denote like parts. A buffer chamber 160 is integrally formed with ink container 20. Buffer chamber 160 includes an air communication port 162 on the top portion thereof and a through hole 163 on the bottom portion thereof. Through hole 163 is connected to an air communication port 55 formed on holder 51. Through hole 163 and air communication port 55 may be engaged with each other in a liquid tight manner by a projection 164.

In this embodiment, the ink contained in ink container 20 and ink reservoir 54 is prevented from overflowing into air communication port 55 by the capillary force of porous member 52. At the same time, the ink is maintained at a negative pressure so that printing may be carried out by recording head 35 by means of the capillary force of porous member 52 through air communication port 55, buffer chamber 160 and communication port 162.

When the temperature rises to increase the pressure of a space 20*a* of ink container 20, the quantity of ink discharged into ink reservoir 54 is greater than the quantity of ink to be consumed by recording head 35. In addition, the pressure of space 20*a* becomes greater than the capillary force of porous member 52. As a result, the ink overflows into buffer chamber 160 through air communication port 55 so that the ink can be prevented from leaking out externally. Thereafter, when the temperature falls so as to decrease the pressure of the interior of ink container 20 or the quantity of the ink consumed by recording head 35 increases to lower the pressure in ink reservoir 54, then the ink that has flowed into buffer chamber 160 is allowed to flow through porous member 52 into ink reservoir 54, where the ink is collected and is supplied for printing.

Accordingly, the cost of porous member 52 may be reduced, because the capillary force of porous member 52 may be reduced while at the same time maintaining a negative pressure suitable for printing. In the above-mentioned embodiments, porous members 33 and 44 communicating with ink supply passage 36 are formed with an affinity for the ink. However, it is not always necessary to provide a porous member with an affinity for the ink, since the ink may pass through the porous members to the recording head by the negative pressure applied from suction pump 10 to the recording head when a new ink cartridge has been mounted on the recording head.

Figure 11:
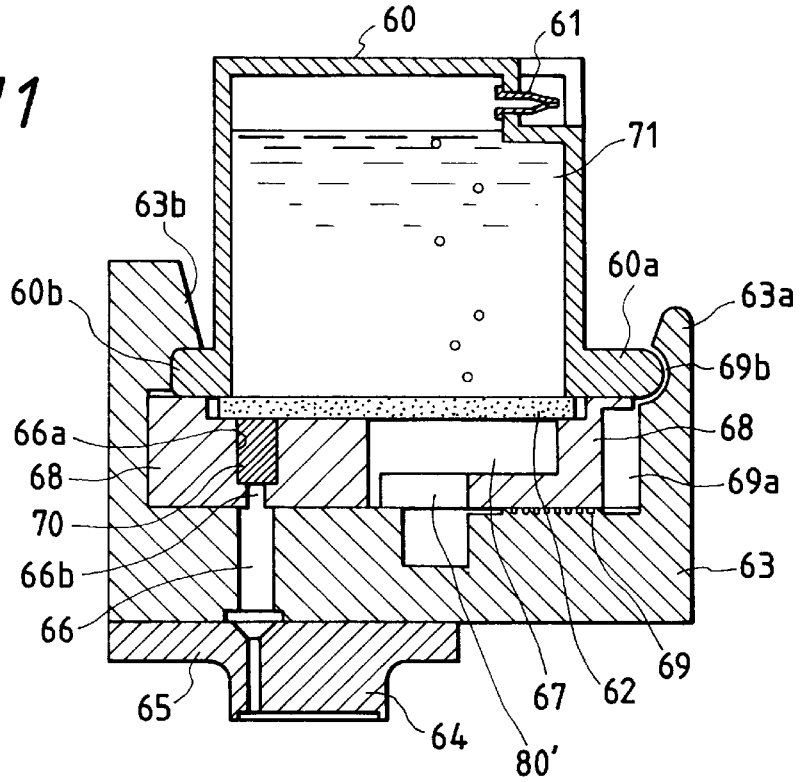
FIG. 11 is a side sectional view of another embodiment of an ink supply device in accordance with the invention.
Figure 12:
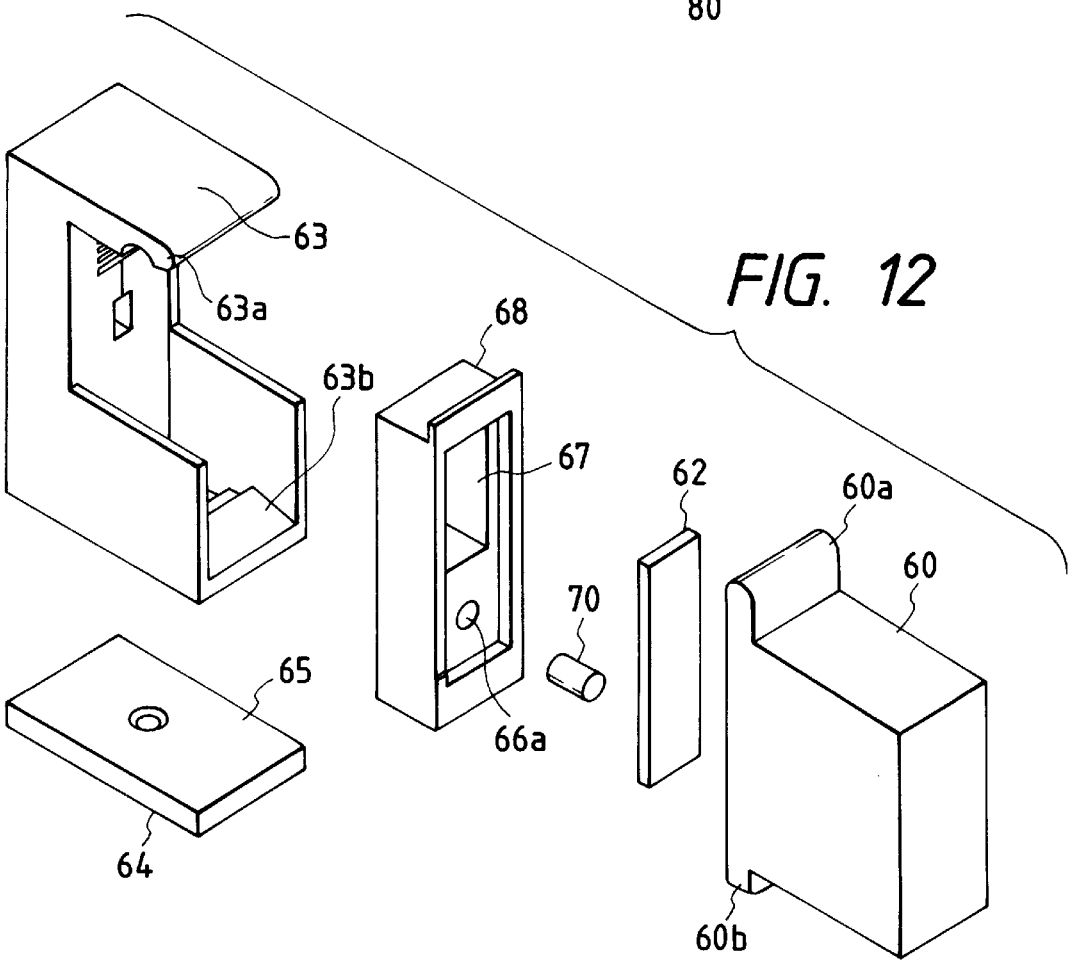
FIG. 12 is an exploded perspective view of the ink supply device of FIG. 11.

Reference is now made to FIGS. 11 and 12, which disclose another embodiment of an ink supply device according to the invention. An ink container 60, formed of transparent polyolefin or the like, is removably mounted on a holder 63. Ink container 60 includes a positive pressure escape assembly 61 on one side thereof. In this embodiment, a check valve is used as a positive pressure escape assembly 61, while the opening of ink container 60 is sealed by a plate-shaped porous member 62, which is connected to the opening by ultrasonic welding or the like. Porous member 62 may be obtained by sintering pulverulent material of polyolefin or the like into a plate having a porosity of 35%. A surface active agent is applied to porous member 62 so that porous member 62 may provide an affinity for the ink.

Thus, material of the porous member is hydrophilic with ink. Other than the sindered materials, the porous members may be a foamed material formed of polyvinyl alcohol or a polyethylene fiber which is soldered by a binder such as resin or the like.

Holder 63 includes a head fixing portion 65 on a bottom portion thereof with a recording head 64 mounted on head fixing portion 65. A connecting member 68 is also positioned on the interior of holder 63 and includes a window 67 in registration with porous member 62 and in communication with the air as described below. Ink container 60 is fixed onto holder 63 in such a manner that porous member 62 forms the bottom surface thereof. Holder 63 includes recessed portions 63*a* and 63*b* for engaging projections 60*a* and 60*b* of ink container 60. An ink supply passage 66 is positioned on the bottom wall of holder 63. Ink supply passage 66 communicates with a first narrower opening 66*b* in connecting member 68, which in turn communicates with a larger opening 66*a* in registration with the recording head side of porous member 62. Ink container 60 holds connecting member 68 within the interior of holder 63.

A continuous groove 69 is positioned between holder 63 and connecting member 68. One end of continuous groove 69 is in communication with window 67 and the other end is in communication with the air to form a capillary through passage 69*a* between a side of connecting member 68 and a side wall of holder 63 and through a passage 69*b* between projection 60*a* and recessed portion 63*a*. A connecting member 70 is formed of a porous material with an affinity for ink and is received in and projects slightly from opening 66*a*. Connecting member 70 is in elastic contact with porous member 62.

Ink container 60 is removably mounted on holder 63. Porous member 62 forms the bottom surface of ink container 60 so that ink 71 in ink container 60 is absorbed into porous member 62. Because porous member 62 naturally holds ink due to the capillary force thereof, there is no possibility that the ink can leak out externally from porous member 62. On the other hand, because connecting member 70 is in elastic contact with porous member 62, the ink is allowed to penetrate into connecting member 70 due to the capillary force of connecting member 70.

When a negative pressure is applied to recording head 64, the ink flows out from connecting member 70 into ink supply passage 66 and further into recording head 64. If printing starts when the ink loading operation is finished, the ink is consumed by recording head 64 so that a negative pressure equal to or greater than the capillary force of porous member 62 is applied to ink supply passage 66. As a result, the ink of ink container 60 is allowed to flow through porous member 62 and connecting member 70 into ink supply passage 66.

In this manner, if the pressure of ink container 60 is decreased to a level equal to or less than the capillary force of porous member 62, then air is allowed to flow from window 67 through porous member 62 into ink container 60. When the pressure of ink container 60 then rises to a level approximately equal to the capillary force of porous member 62, the inflow of the air through porous member 62 stops, thereby maintaining ink container 60 at a given negative pressure. Under these conditions, the ink solvent that is evaporated from the portion of porous member 62 facing window 67 is trapped by groove 69. Thus, the partial pressure of the evaporated solvent is approaching saturation. Therefore, the evaporation of the ink from the portion of porous member 62 facing window 67 may be substantially prevented.

On the other hand, if the environmental temperature increases and the pressure of ink container 60 also increases to atmospheric pressure or higher, then positive pressure escape assembly 61 is opened to thereby lower the pressure of ink container 60. This prevents the excessive supply of the ink to be directed to recording head 64 as well as the leakage of the ink from window 67.

Figure 13:
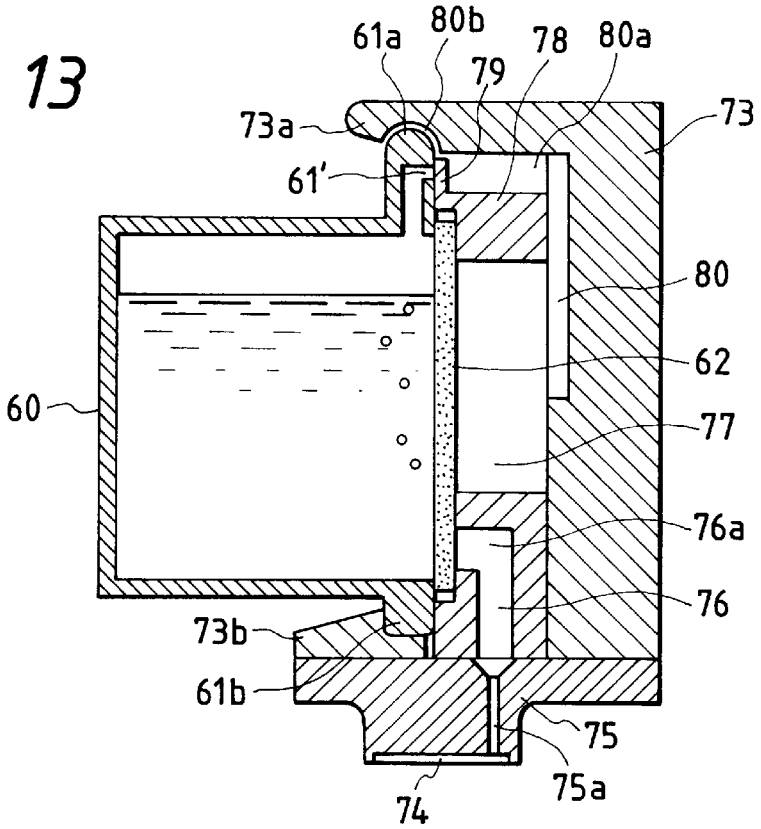
FIG. 13 is a side sectional view of another embodiment of an ink supply device in accordance with the invention.

In the embodiment of FIGS. 11 and 12, the ink is supplied to the print head in an arrangement where porous member 62 serves as the bottom surface of ink container 60. Alternatively, as shown in FIG. 13, ink container 60 is mounted in such a manner that porous member 62 is arranged in the vertical direction, but still operates in a similar manner. An ink supply portion 75 including a recording head 74 is formed on the bottom surface of a holder 73. To position ink container 60 so that porous member 62 is arranged in the vertical direction, holder 73 includes recessed portions 73*a* and 73*b* to engage with projection 61*a* and 61*b* provided in ink container 60. A connecting member 78 is positioned in the interior of holder 73 and includes a window 77 in an upper portion thereof, which is connected with an air communication passage 80. Air communication passage 80 is connected to the air by passages 80*a* and 80*b*. An ink supply passage 76, including an opening 76*a* in airtight contact with the lower portion of porous member 62, is positioned in the lower portion of the interior of holder 73 and connecting member 78 and communicates with ink supply passage 75' in ink supply portion 75.

An opening 61' is positioned at the upper portion of ink container 60. A diaphragm valve 79 is positioned opposite opening 61'. Under normal conditions, opening 61' is opened when the pressure of the interior of ink container 60 becomes a positive pressure. When ink holder 60 is mounted on holder 73, the ink makes contact with porous member 62. The capillary force of porous member 62 allows the ink to penetrate into the entire area of porous member 62 ranging from the lower portion to the upper surface thereof. Since porous member 62 can hold the ink due to the capillary force thereof, there is no possibility that the ink can leak out externally from porous member 62.

At the initial ink loading operation, a negative pressure is applied to recording head 74 by suction pump 10 through cap member 9, then the ink is allowed to flow out from porous member 62 into ink supply passage 76 and further into recording head 74. When the ink loading operation is completed and printing is initiated, the ink is consumed by recording head 74. Thus, a negative pressure equal to or greater than the capillary force of porous member 62 is applied to ink supply passage 76. As a result, the ink of ink container 60 is allowed to flow through porous member 62 and into ink supply passage 76.

If the pressure of ink container 60 is decreased to a level equal to or less than the capillary force of porous member 62, then the air is allowed to flow from window 77 through porous member 62 into ink container 60. When the pressure of ink container 60 increases to a level approximately equal to the capillary force of porous member 62, then the inflow of the air through porous member 62 stops. Therefore, the pressure of ink container 60 may be maintained at a given negative pressure. If the pressure of ink container 60 increases to atmospheric pressure or higher due to the increased environmental temperature, then diaphragm valve 79 is opened to thereby lower the pressure of ink container 60. This prevents the excessive supply of the ink to recording head 74 as well as the leakage of the ink from window 77.

Figure 14:
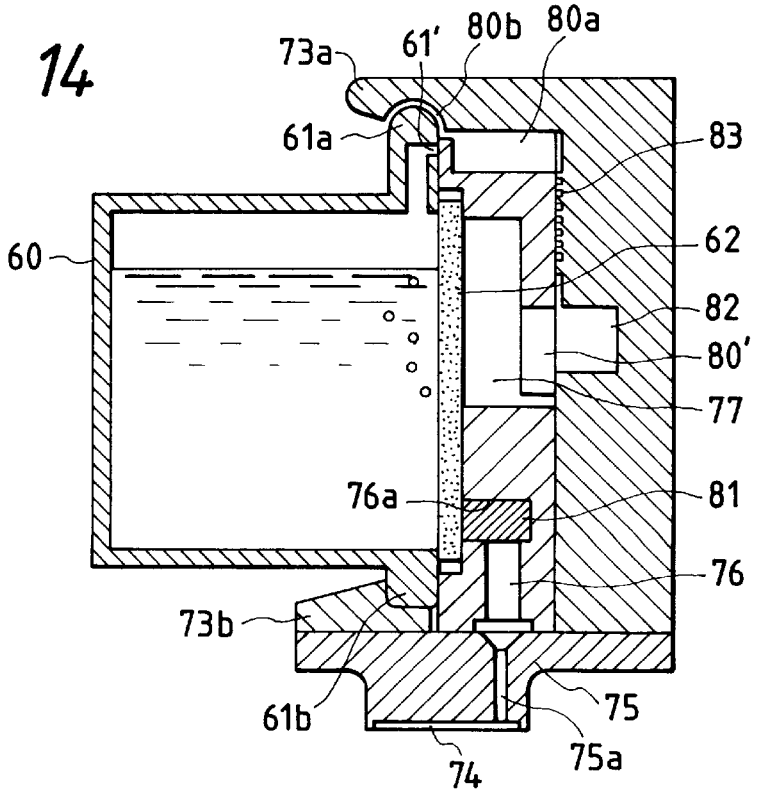
FIG. 14 is a side sectional view of another embodiment of an ink supply device in accordance with the invention.

Alternatively, the construction of FIG. 13 may be modified as shown in FIG. 14. There, a connecting member 81 is positioned in opening 76*a* of ink supply passage 76, operating in the same manner as connecting member 70 of FIG. 11. A circuitous groove 83 is provided between and air communication passage 82 to trap the evaporated component of the ink solvent in the same manner as discussed above with FIGS. 11 and 12. A passage 80' communicates between window 77 and passage 82.

Figure 15:
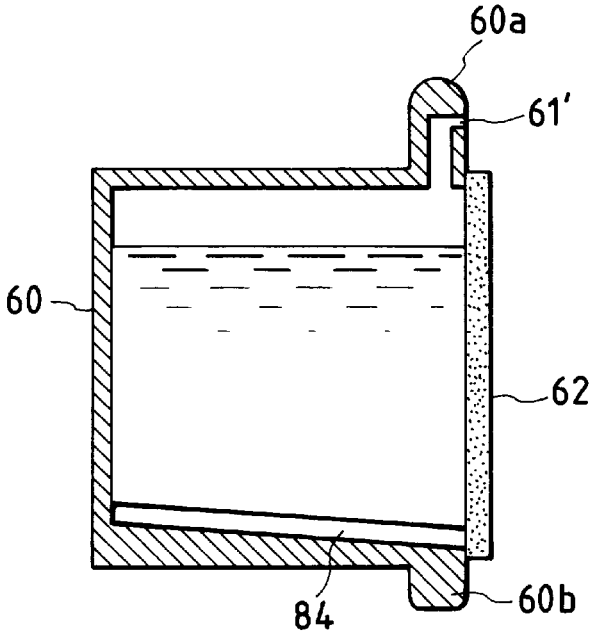
FIG. 15 is a side sectional view of another embodiment of an ink container in accordance with the invention.
Figure 16:
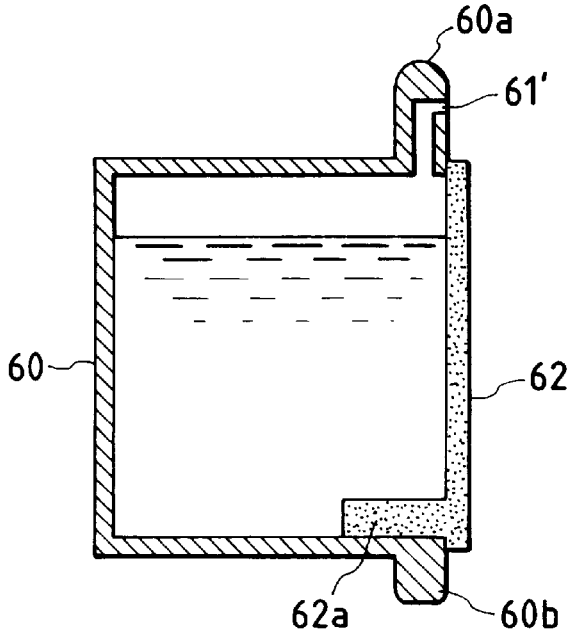
FIG. 16 is a side sectional view of another embodiment of an ink container in accordance with the invention.

Reference is now made to FIGS. 15 and 16, which disclose further embodiments of the ink container employed in the invention, and more specifically to the embodiments where a side surface of the container is a porous member. In these embodiments, a groove 84 may be positioned on the lower interior side of container 60 (FIG. 15) or a pleat portion 62*a* may be formed in the lower portion of porous member 62 and extend into the ink container (FIG. 16). In this manner, when the quantity of the ink becomes small, the ink can be guided efficiently to porous member 62 by means of groove 84 or pleat portion 62*a*.

Figure 17:
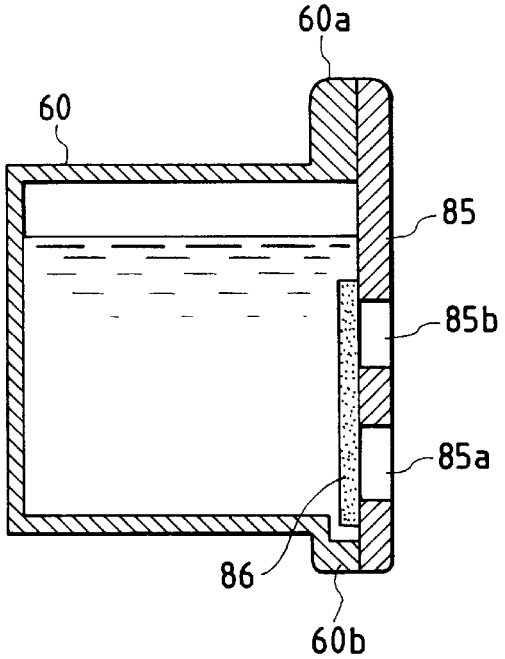
FIG. 17 is a side sectional view of another embodiment of an ink container in accordance with the invention.

In the embodiments of FIGS. 15 and 16, the whole surface of the opening of the ink container 60 is sealed by the porous member. However, this construction is not limitative. As shown in FIG. 17, the opening of ink container 60 is sealed with a cover member 85 including through holes 85*a* and 85*b* formed at positions facing the ink supply passage and the window for communication with the air respectively. Further, through holes 85*a* and 85*b* may be sealed by a porous member 86. Then, it is possible to use a porous material having a low strength for porous member 86. As a result, the breakage of porous member 86 may be substantially prevented. Even a porous member having a small area can be effectively used in a large-sized ink container, thereby being able to reduce the cost thereof. Instead of the through holes 85*a* and 85*b* formed on cover member 85 in the above embodiments, a wall member constituting the ink housing body may be formed with through holes.

Figure 18:
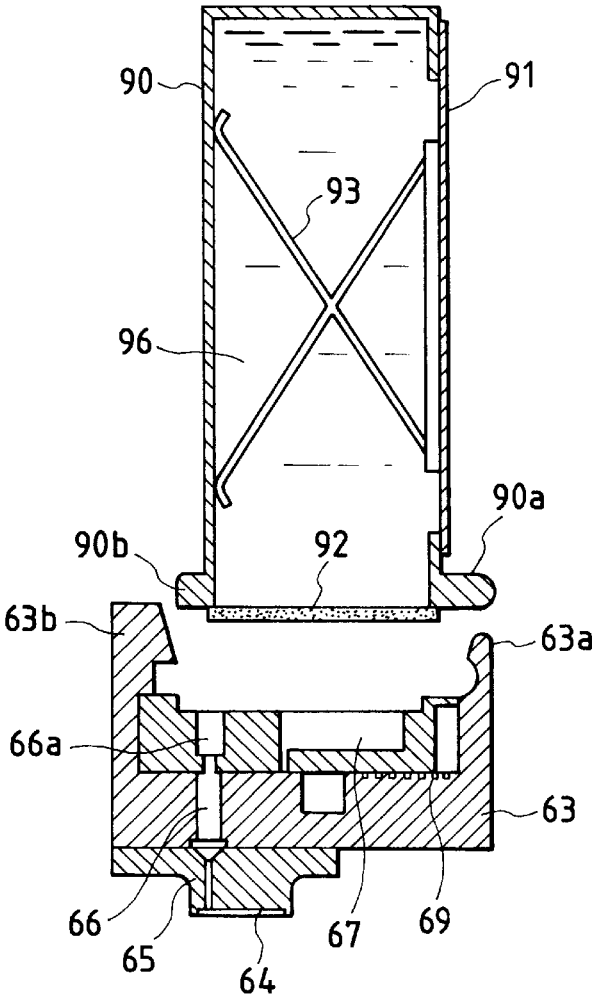
FIG. 18 is a side sectional view of another embodiment of an ink supply device in accordance with the invention.

Reference is now made to FIG. 18, which shows another embodiment of an ink supply device according to the invention. An ink container 90 includes a flexible wall 91 on one side thereof. Container 90 also includes a porous member 92 mounted in a manner similar to that discussed above with FIGS. 11 and 12. Ink container 90 is mounted on holder 63 also in a manner similar to that discussed with FIGS. 11 and 12. Ink container 90 is normally energized from the inside by a widening spring 93, which is provided inside ink container 90 for adjusting the pressure of ink container 90. Projections 90*a* and 90*b* engage with recessed portions 63*a* and 63*b* formed in holder 63.

Figure 19A:
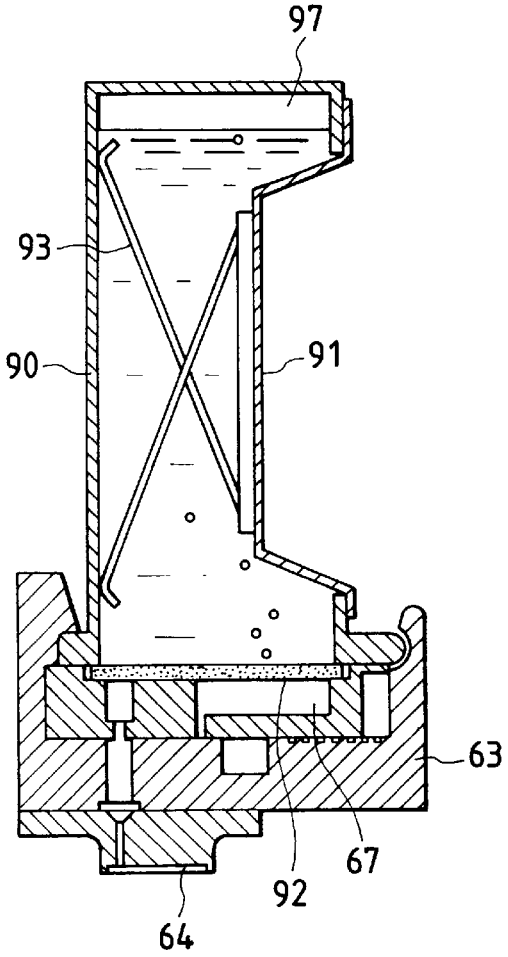
FIG. 19(*a*) is a side sectional view of the ink container of FIG. 18.
Figure 19B:
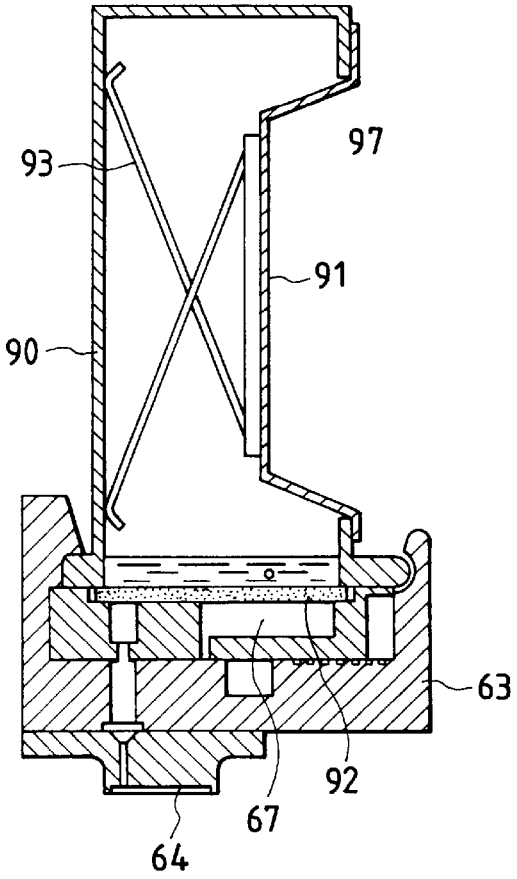

Flexible wall 91 is structured based on the formula: $Vf \geqq 1.5\ Ve$, where Vf expresses the volume of the ink container when it is filled with ink as shown in FIG. 18 and Ve expresses the volume thereof when the ink is replaced by the air as shown in FIGS. 19(*a*) and 19(*b*). The formula takes into consideration the volume expansion rate of a gas when it is used under the temperature environment of 0° C. to 60° C. so that the volume of the ink tank is allowed to vary from the volume Vf to the volume Ve.

Figure 20A:
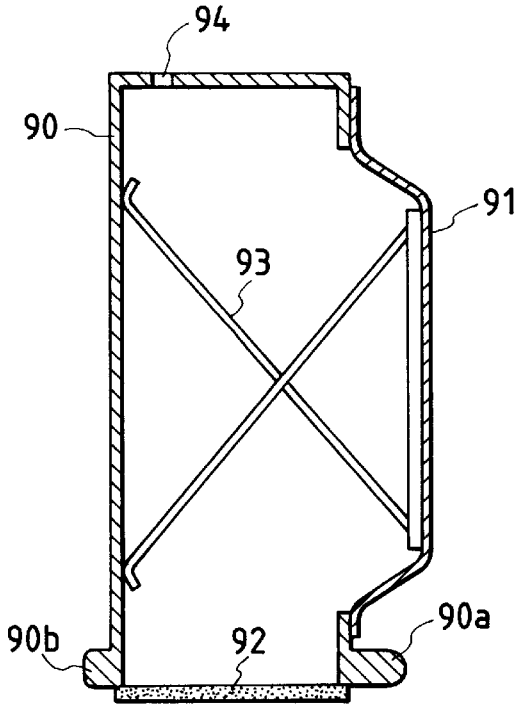
FIG. 20(*a*) is a side sectional view of the ink container of FIG. 18 showing a state thereof before the ink is poured into the ink container.
Figure 20B:
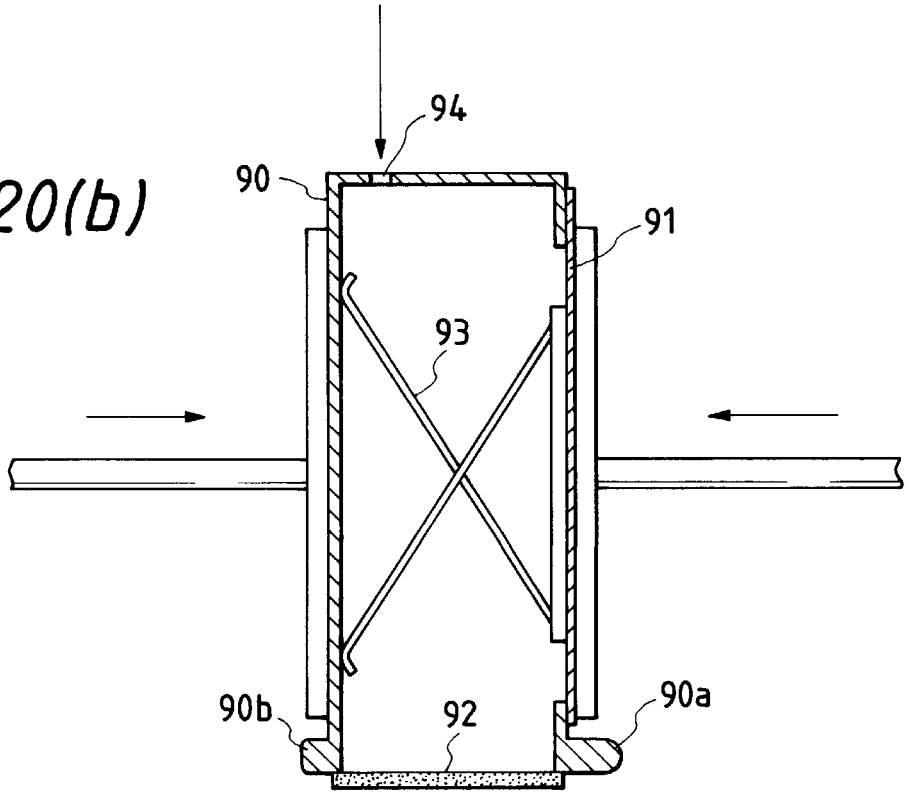

To store ink in ink container 90 when ink container 90 is energized and expanded under no load condition by widening spring 93 as shown in FIG. 20(*a*), container 90 is pressed and held from both sides as shown in FIG. 20(*b*). The ink is poured into ink container 90 through an ink pouring hole 94 formed in the upper portion of container 90. Ink pouring hole 94 is closed by a seal or the like. The application of the external force to ink container 90 is then removed. As a result, as shown in FIG. 18, flexible wall 91 of ink container 90 receives the force to expand outwards by the outwardly expanding property of widening spring 93 to thereby generate a negative pressure within ink container 90.

The ink penetrates into the minute pores of porous member 92. Thereafter, the ink is prevented from flowing out therefrom by the capillary forces of the minute pores. At the same time, the entry of the air into ink container 90 is also prevented. Therefore, even if ink container 90 is removed from holder 63, there is no danger that ink can leak out from ink container 90. If ink container 90 is mounted on holder 63 and printing is carried out, then ink 96 within ink container 90 is reduced in quantity. In response thereto, flexible wall 91 deforms inwardly so as to react with the reduced quantity of ink 96.

Figure 21:
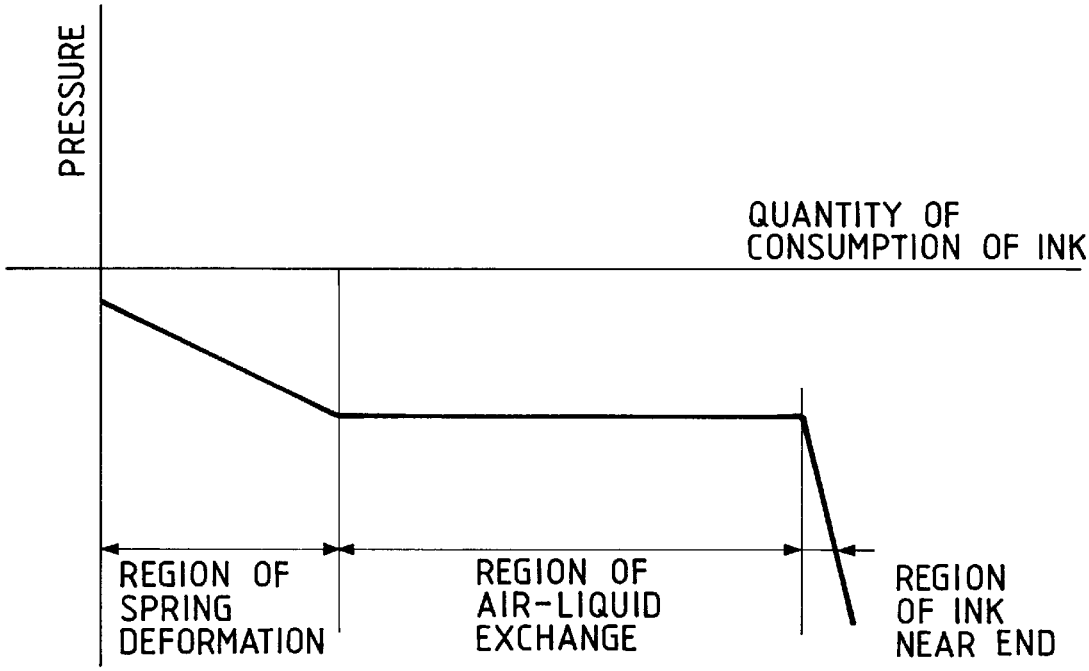
FIG. 21 is a diagrammatic view of the quantity of consumption of ink and variations in a negative pressure within the ink tank of FIG. 18.

As shown in FIG. 21, the negative pressure of ink container 90 gradually increases. If the quantity of ink 96 is reduced and thus the inward deformation of flexible wall 91 reaches the point where the spring force is equal to the capillary force of porous member 92, then the negative pressure overcomes the capillary force produced in porous member 92. Therefore, as shown in FIG. 19(*a*), the air is taken in from porous member 92 to thereby form a space 97 and bring the interior of ink container 90 into an equilibrium condition. This process is carried out until the ink in ink container 90 is consumed up almost completely including the reduction in the quantity of ink 96 and the inflow of the air as shown in FIG. 19(*b*).

Figure 22:
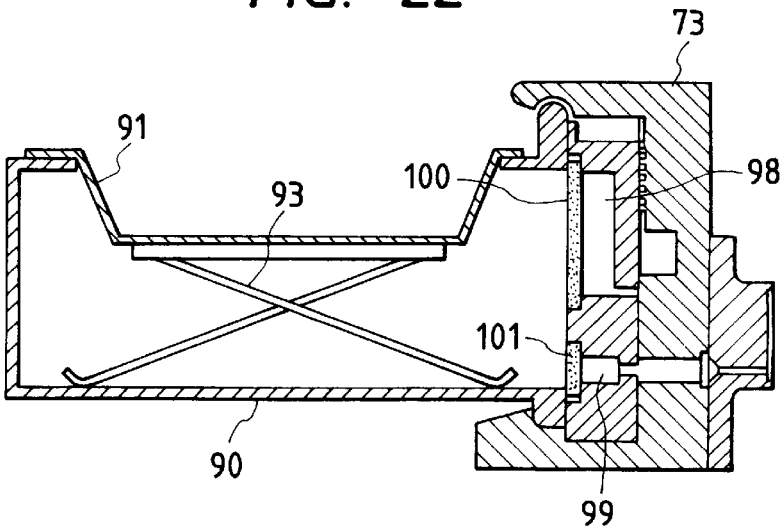
FIG. 22 is a side sectional view of another embodiment of an ink container in accordance with the invention.

In the above embodiment, the opening of ink container 90 is sealed by a single piece of porous member 92. However, this is not limitative. As shown in FIG. 22, porous members 100 and 101 are provided only in limited areas of ink container 90. That is, opposed to an air communication window 98 and an ink supply port 99, respectively. Porous members 100 and 101 are separated from each other such that one of them can be used for ink supply and the other for air communication, so that it is possible to have porous members with pore diameters suitable for their respective purposes. For example, porous member 101 may have minute pores to serve as a filter for the ink supply.

Figure 23:
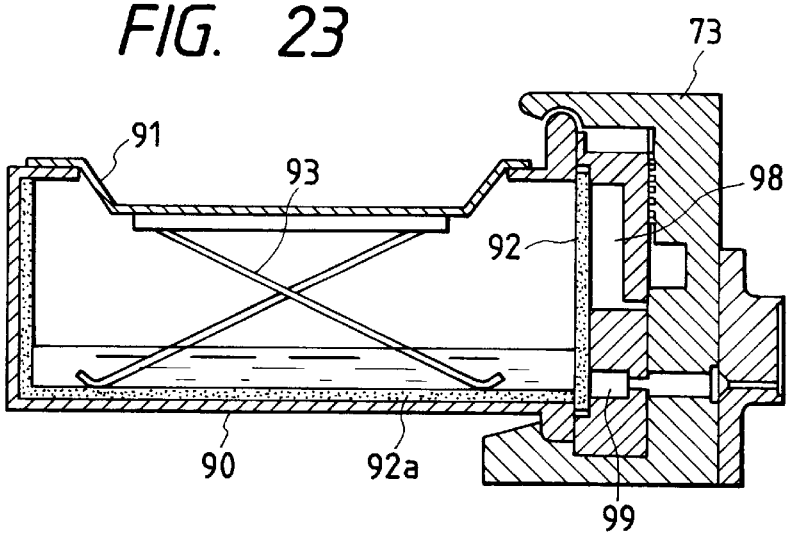
FIG. 23 is a side sectional view of another embodiment of an ink container in accordance with the invention.

Even when porous member 92, which covers the opening of ink container 90, is structured such that it includes an extension portion 92*a* extending along the inner wall of ink container 90 as shown in FIG. 23, ink container 90 may be arranged horizontally before it is used. In this manner, the ink in contact with extension portion 92*a* may be guided to porous member 92 by means of the capillary action of extension portion 92*a*. As a result, this arrangement achieves a similar air and ink replacement action to the above-mentioned described embodiments. Flexible wall 91 is normally widened outwardly by spring 93 in the above-mentioned embodiment. However, flexible wall 91 may be formed of rubber or the like having elasticity in a hemispherical shape and an energizing force may be applied to the flexible wall so that the flexible wall itself is able to widen outwardly.

Figure 24A:
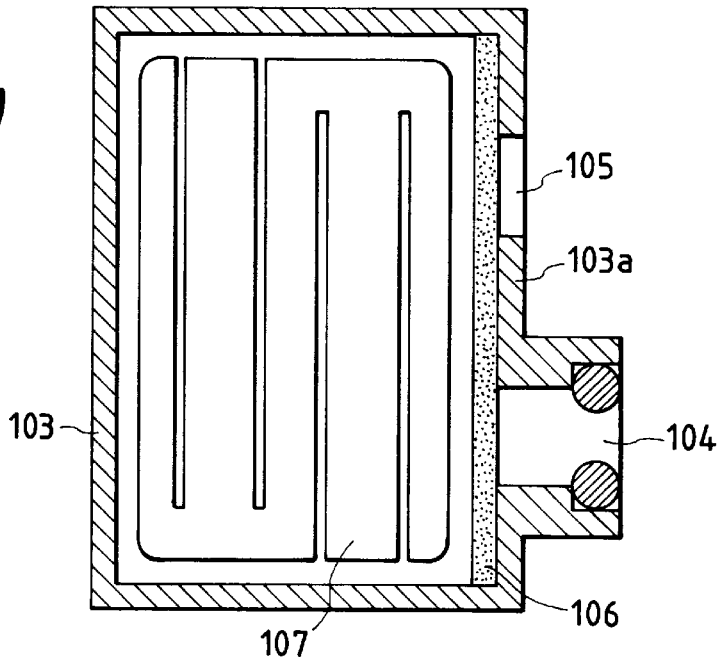
FIG. 24(*a*) is a side sectional view of another embodiment of an ink container in accordance with the invention.
Figure 24B:
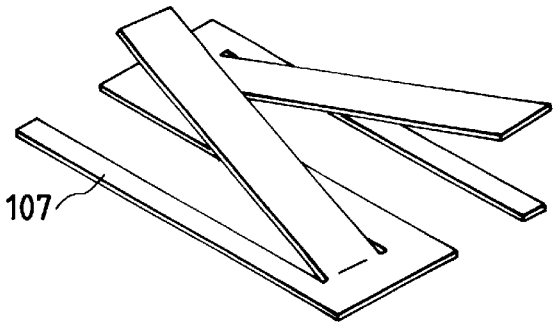

Further, as shown in FIGS. 24(*a*) and 24(*b*), an ink container 103 includes a flexible wall (not shown) on one side thereof. Ink container 103 includes a mounting surface 103*a* for mounting the ink container onto a holder. An ink supply port 104 may be provided for communication with the recording head and an opening 105 for communication with the air. A porous member 106 may be provided so as to cover ink supply port 104 and opening 105, and a plate spring 107 (FIG. 24(*b*)) may be used to normally energize and widen the flexible wall outwardly. Based thereon, the ink supply device can be made compact.

According to the invention, an ink supply device is provided which comprises an ink container forming a closed space and a holder including on one side thereof an ink jet type recording head for holding the ink container in such a manner that the ink container can be mounted thereon and removed therefrom. In this structure, the ink stored in the ink container is supplied from the opening of the ink container through an ink supply passage to the recording head and the ink container is in communication with the air through an opening communicating with a porous member having an affinity for the ink. As a result, a negative pressure is maintained in the ink container by means of the capillary force of the porous member having a wide area. In addition, a constant negative pressure may be maintained corresponding to a large quantity of ink consumed by the recording head, thereby being able to supply the ink to the recording head properly and positively. In a preferred embodiment, the holder and ink container are formed of plastic. In all the embodiments, the ink container may be formed from transparent or translucent material.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An ink supply device for use in an ink jet printer having an ink jet type recording head moveable in a scanning direction across a medium for outputting ink, comprising: a holder having a first side and a second side, the ink jet type recording head being mounted on the first side of said holder in a vertical direction, said vertical direction being perpendicular to the scanning direction, said holder having at 1least one space receiving at least one porous member having an affinity for ink; an ink container including a closed space for storing ink, said ink container being removably mounted on said second side of said holder in said vertical direction, said ink container further including at least one opening communicating with said holder; an ink supply passage positioned in said holder transporting ink from said ink container to said ink jet type recording head, said porous member being disposed below said ink container and above said ink supply passage; and an air port formed through at least one of said first side and said second side of said holder for receiving air, said air port being adjacent with said at least one porous member having an affinity for ink; wherein ink stored in said ink container flows from said at least one opening of said ink container through said ink supply passage into said ink jet type recording head and said ink container being in communication with the air received by said air port through said at least one porous member.

2. The ink supply device of claim 1, wherein said ink supply passage is connected with said ink container through said at least one porous member.

3. The ink supply device of claim 1, further comprising a pair of spaced electrodes in said holder for detecting near ink end.

4. The ink supply device of claim 1, wherein said at least one porous member is formed of porous ceramics.

5. The ink supply device of claim 1, wherein said at least one porous member is formed of a hollow thread bundle.

6. The ink supply device of claim 1, wherein said at least one porous member has a pore diameter of approximately 20 $\mu$m.

7. The ink supply of device of claim 1, wherein said holder inlcudes at least two spaced electrodes in the vicinity of said supply passage for monitoring an amount of ink remaining in said ink supply device.

8. The ink supply device of claim 1, wherein said ink container is formed from either transparent or translucent material.

9. The ink supply device of claim 1, wherein at least one diaphragm valve is disposed in said ink container for covering said at least one opening of said ink container.

10. The ink supply device of claim 9, further comprising a corresponding projection mounted on said holder, said at least one diaphragm valve being opened by said projection when said container is mounted on said holder.

11. An ink supply device for use in an ink jet printer having an ink jet type recording head movable in a scanning direction for outputting ink, comprising: a holder having a first side and a second side, the ink jet type recording head being mounted on the first side of said holder in a vertical direction, said vertical direction being perpendicular to the scanning direction, said holder having at least one space receiving at least one porous member having an affinity for ink; an ink container including a closed space for storing ink, said ink container being removably mounted on said second side of said holder in said vertical direction, said ink container further including at least one opening for communicating with said holder; an ink supply passage positioned in said holder and to transport ink from said ink container to said ink jet type recording head, said porous member being disposed below said ink container and above said ink supply passage; and an air port formed through at least one of said first side and said second side of said holder for receiving air, said air port being adjacent to said at least one porous member having an affinity for ink; wherein ink stored in said ink container flows from said at least one opening of said ink container through said ink supply passage into said ink jet type recording head and said ink container being in communication with the air received by said air port through said at least one porous member; wherein said space of said holder includes a first space and a second space; said first space receiving said at least one porous member in contact with said air port and said second space forming an ink reservoir communicating with said ink supply passage.

12. An ink supply device for use in a ink jet printer having an ink jet type recording head moveable in a scanning direction for outputting ink, comprising: a holder having a first side and a second side, the ink jet type recording head being mounted on the first side of said holder in a vertical direction, said vertical direction being perpendicular to the scanning direction, said holder having at least one space receiving at least one porous member having a affinity for ink; and ink container including a closed space for storing ink, said ink container being removably mounted on said second side of said holder in said vertical direction, said ink container further including at least one opening for communicating with said holder; and ink supply passage positioned in said holder and to transport ink from said ink container to said ink jet type recording head, said porous member being disposed below said ink container and above said ink supply passage; and an air port formed through at least one of said first side and said second side of said holder for receiving air, said air port being adjacent to said at least one porous member having an affinity for ink; wherein ink stored in said ink container flows from said at least one opening of said ink container through said ink supply passage into said ink jet type recording head and said ink container being in communication with the air received by said air port through said at least one porous member; wherein said space of said holder includes a first space and a second space and further comprising another porous member, the at least one porous member adjacent said air port being in said first space and the another porous member being in the second space in contact with said ink supply passage.

13. An ink supply device for use in an ink jet printer having an ink jet type recording head for outputting ink, comprising: a holder having a first side and a second side, the ink jet type recording head being mounted on the first side of said holder, said holder having at least one space receiving at least one porous member having an affinity for ink; an ink container including a closed space for storing ink, said ink container being removably mounted on said second side of said holder, said ink container further including at least one opening for communicating with said holder; an ink supply passage positioned in said holder and to transport ink from said ink container to said ink jet type recording head, said porous member being disposed below said ink container and above said ink supply passage; and an air port formed through at least one of said first side, and said second side of said holder for receiving air, said air port being adjacent to said at least one porous member having an affinity for ink; wherein ink stored in said ink container flows from said at least one opening of said ink container through said ink supply passage into said ink jet type recording head and said ink container being in communication with the air received by said air port through said at least one porous member;

said space of said holder including a first space and a second space and further comprising another porous member, the at least one porous member adjacent to said air port being in said first space and the another porous member being in the second space in contact with said ink supply passage;

wherein said at least one porous member in communication with said air port has a greater affinity for ink than said another porous member in communication with said ink supply passage.

* * * * *